United States Patent [19]

Yamagata

[11] Patent Number: 4,739,595

[45] Date of Patent: Apr. 26, 1988

[54] WORSHIPPING SYSTEM

[76] Inventor: George Yamagata, 5-10, 5-chome, Hatazawa Minami, Kisarazu-shi, Chiba-ken, Japan

[21] Appl. No.: 11,872

[22] Filed: Feb. 6, 1987

[30] Foreign Application Priority Data

Apr. 10, 1986 [JP] Japan ..... 61-81111

[51] Int. Cl.[4] ..... E04H 13/00

[52] U.S. Cl. ..... 52/134; 52/136; 312/33

[58] Field of Search ..... 52/133, 134, 136, 137, 52/6; 312/33; 434/245

[56] References Cited

U.S. PATENT DOCUMENTS

| | | | |
|---|---|---|---|
| 470,319 | 3/1892 | Eummelen | 312/33 X |
| 1,585,411 | 5/1926 | Patterson | 52/134 X |
| 2,034,633 | 3/1936 | Roberts | 52/136 |
| 2,847,722 | 8/1958 | Wedeking | 52/6 |
| 3,938,287 | 2/1976 | Gauchard | 52/134 |
| 4,145,099 | 3/1979 | Mitchell | 312/195 X |
| 4,227,047 | 10/1980 | Horne | 52/6 X |
| 4,332,113 | 6/1982 | Moore | 52/6 |

FOREIGN PATENT DOCUMENTS

| | | | |
|---|---|---|---|
| 140928 | 4/1920 | Canada | 312/33 |
| 745447 | 11/1966 | Canada | 312/33 |

*Primary Examiner*—Carl D. Friedman
*Assistant Examiner*—Creighton Smith
*Attorney, Agent, or Firm*—Lee C. Robinson, Jr.

[57] ABSTRACT

A worshipping system comprises a worshipping room having an altar, an area for storing a number of cinerary urns, visible means provided in said worshipping room for visually suggesting the movement of the spirits from the cinerary urns to the altar, and control means for actuating said visible means. When necessary codes such as the number of the family or the deceased concerned are inputted into the input unit of the control means, the visible means simulates the transfer of the spirit of the deceased from the cinerary urn to the worshipped object. This causes the worshippers of their ancestors to feel that the spirit in the cinerary urn has been united to the worshipped object through the visible means.

4 Claims, 1 Drawing Sheet

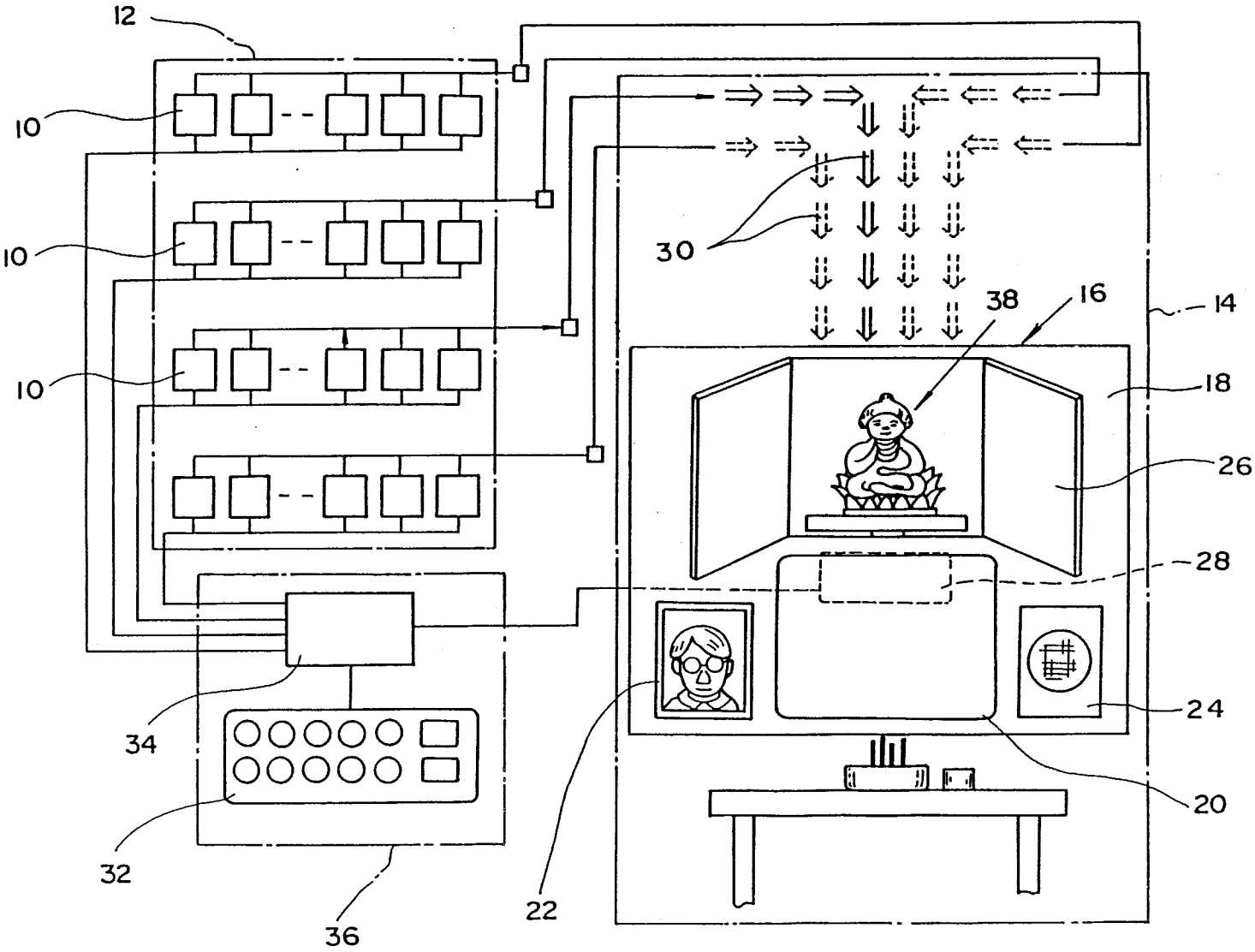
14
18
26
28
24
20
16
38
30
22
36
12
10
10
10
34
32

WORSHIPPING SYSTEM

FIELD OF THE INVENTION

The present invention relates to a system used for religious services, and more particularly to a system capable of providing religious services adapted to any desired sect in Buddhism at a fixed place in a building storing a number of cinerary urns in a given space therein.

BACKGROUND OF THE INVENTION

In general, the cineraly urns of the deceased are stored in a graveyard in a temple-yard or churchyard of a religious section, such as Buddhism, Mohammedanism and Christianity, to which the deceased belong. A tomb has usually been constructed for each of the deceased or each of the families to which the deceased belonged, and furthermore, if the permanent residence of a family changes, a new tomb has been constructed in a region near the new residence. Therefore, the demand for new tombs increases over the capacity of the existing graveyards, and the demand for the land for graveyards steadily increases. For this reason, particularly in large cities where the land prices are high and the land which can be diverted to the graveyard is limited, there has been a problem that not only the securing of the land for graveyard becomes difficult, but also the price of a grave becomes higher.

To solve this problem, in the urban area it has already been attempted to store the remains in a three-dimensional locker form arrangement. However, also in such a case, the problems that the acquisition of land is difficult and that the price of a grave is high remained unsolved.

To overcome the above problems, Japanese Patent Application No. 194955/85 filed by the applicant of the present application discloses a charnel facility which permits those belonging to different religions or religious sects to worship the deceased at the same place in accordance with the respective religious service practice of the different religions or religious sects. The charnel facility is constructed so that when a family worships the deceased of the family at the charnel facility, the cinerary urn of the deceased is moved to the altar, and an ornamental cover in accordance with the religious sect is placed on the urn. This enables those belonging to the different religious sects to worship the deceased at the same place by moving the cinerary urn with an ornamental cover, thereby permitting the storage of the remains of a large number of families in a given building independently of the religious sects to which the families belong, thus resulting in the effective use of the land and the space.

However, to move the cinerary urns to the altar, the provision of some carriage means is required and results in the increase of the cost. Also, the proportion of the space occupied by the carriage means itself in the building becomes large.

SUMMARY OF THE INVENTION

Therefore, it is an object of the present invention to provide a worshiping system having the advantages similar to those of the previous invention of the above mentioned Japanese Patent Application No. 194955/85, that is those in which individuals belonging to the different religions and religious sects can perform a religious service for worshiping their ancestors at the same place by storing the cinerary urns of a number of families in a building, said system also not requiring complicated means for moving the cinerary urns and providing much information relating to the ancestors of a family to give satisfaction to those visting the system to worship their ancestors, whereby said system is economical and can store more cinerary urns in the same space as that occupied by the prior building for storing the cinerary urns.

According to the present invention, the above object is achieved by a system comprising a worshiping room provided with an altar, an area for storing a large number of cinerary urns, visible means provided in said worshiping room for visually suggesting the movement of the spirits from the cinerary urns to the altar, and control means for actuating said visible means.

Other objects and advantages of this invention will hereinafter become apparent from the following description of a preferred embodiment of this invention.

BRIEF DESCRIPTION OF THE DRAWING

The single drawing FIGURE is a schematic diagram showing an embodiment of a worshiping system in accordance with the present invention.

DESCRIPTION OF PREFERRED EMBODIMENT

An embodiment of the present invention will now be described in reference with the drawings. The accompanying FIGURE is a schematic representation showing an embodiment of a worshiping system in accordance with the present invention. This system is generally installed in a building, which system including a cinerary urn storing area 12 (enclosed by dot-dash line) storing a number of cinerary urns 10 and a plurality of worshiping rooms 14 (enclosed by dot-dash line) in which visitors pray to and worship the departed souls. In the room 14, an altar 16 comprising an altar panel 18 is provided. The panel 18 has a display portion 20 such as a CRT viewing screen on which information concerning the deceased and his or her family line, is displayed, a photo screen 22 displaying the photographs of the deceased or the ancestors, and a speaker 24. The altar panel 18 is provided with leaves 26, at the back of which carriage means 28 capable of moving back and forth relative to the leaves are provided. In the room 14 a plurality of series of visible bodies 30 are arranged from the back corners of the room to the altar 16. Each of the cinerary urns 10 is connected to one series of the plurality of series of visible bodies 30. Each series of visible bodies 30 comprise, for example, a number of electric lamps arranged along a line. The operation of the visible bodies 30 is designed so that at the beginning of a worshiping event, the lamps sequentially turn on and off from the back corner of the room 14 to the altar panel 18 in a manner similar to the lamps of conventional outdoor advertising signs or directional arrows, for example. At the end of the event the lamps turn on and off in the reverse sequence to the above case and the light of the visible bodies returns to the back corner of the room 14.

A control room 36 (shown by a dot-dash line) includes a keyboard in which visitors input codes such as their family code number and an electronic control circuit 34 for controlling the operation of the various devices as described above. This electronic control circuit 34 communicates with the cinerary urns 10. When a desired cinerary urn 10 is designated, the visible bodies of the series communicating with the desired cinerary urn 10 are actuated. According to the code number inputted to the keyboard 32, the electronic control circuit 34 displays information such as the posthumous Buddhist name, the secular name, the deathday and the deathage of a deceased concerned on the display portion 20, and furthermore, displays the photograph of the deceased concerned or his or her ancestors on the photo screen 22 and radiates the voice of the deceased concerned over the speaker 24. On the display portion 20, for the convenience of visiting one's family grave in the Bon festival and the equinoctial week, the information concerning all of the deceased of a family whose ashes are stored in the facility or the individual information of a particular deceased may be displayed, or the video in which a picture relating to the deceased while alive is recorded may be shown. The electronic control circuit 34, further, controls opening and shutting of the leaves 26 of the altar panel 18 and traveling of the carriage means 28 in the interior of the leaves, and further selectively displays a worshiped image 38 adapted to the religious sect to which a family of the deceased belongs.

In operation, worshipers at first input necessary codes such as a code number of their family to select and confirm a family or a deceased to worship, and then, enter the worshiping room 14. In response to the input of the codes into the keyboard 32, the electronic control circuit 34 supplys signals for displaying information such as the posthuous Buddhist name, the secular name, the deathday, and the deathage, displaying a photograph of the deceased concerned or the deceased family members in the photo screen 22, setting recording tape in which the voice of the deceased concerned is recorded, and selectively putting a worshiped image 38 according to the religious sect of the family concerned on the carriage means 28.

After the worshipers have entered the worshiping room 14, the electronic control circuit 34 supplies a signal sequentially turning on the visible bodies 30 connected to the selected cinerary urn 10 toward the altar 16.

At the same time when the visible bodies 30 reach the altar 16, the leaves 26 of the altar panel 18 open and the worshiping image 38 moves forward from the back. In this condition the worshipers worship the deceased. At that time, a prayer or a sutra or a message of the deceased while alive is given over the speaker 24.

The visible bodies 30 are not limited to an electric light, but anything may be available which is visible and can visually suggest that the spirit comes down from the cinerary urn 10 to the altar 16 or the worshiping image 38 in the altar 16.

Furthermore, the altar panel 18 may have the outer surface with an ornament according to the respective religious sect, and may be changed according to the sect to which worshipers belong. In this case, the display portion 20, the photo screen 22, and the speaker 24 are constructed apart from the altar panel 18.

Since the present invention is constructed as described above, not only can it contribute to solving of the graveyard problem concerned with only one religion or one religious sect, but also it enables the religious services of different religions or religious sects to perform in the same building. Therefore, hundreds or thousand times the number of cinerary urns stored in a conventional graveyard may be stored in the space utilizing the same area as that of the conventional graveyard.

Another advantage of the present invention is that since particularly the cinerary urn need not be moved to the worshiping room when it is worshiped, more cinerary urns than in the prior art can be stored in the space of a building, and moreover, since the need of installing means for moving the cinerary urn is eliminated, the system according to the present invention is also very economical.

Furthermore, the present invention causes the worshipers to visually feel the presence of the spirit at the altar in the worshiping room by the visible bodies without the movement of the cinerary urn. Additionally, since the worshiped image according to the religious sect concerned appears, the present invention can give the effects similar to the direct viewing of the cinerary urn.

Furthermore, the system according to the present invention can be used not only for the graves of the human beings, but also for the graves of pets such as dogs and cats.

What I claim is:

1. A worshiping system for persons believing that spirits can travel from urns of the dead to a worshiping room, the system comprising:

a worshiping room;

a storage area remote from the worshiping room for storing a large number of cinerary urns;

means disposed in the worshiping room for providing a display corresponding to a selected one of said stored cinerary urns;

control means connected to said display for actuating the same; and means connected to said control means for visually simulating movement of the spirits from the selected stored cinerary urn to said worshiping room.

2. A worshiping system according to claim 1 further including a plurality of worshiped objects which are displayed by said control means after the operation of said visible means.

3. A worshiping system for persons believing that spirits can travel from urns of the dead to a worshiping room, the system comprising:

a worshiping room;

a storage area remote from the worshiping room for storing a large number of cinerary urns in fixed positions;

means disposed in the worshiping room for providing a video and audio display corresponding to a selected one of said stored cinerary urns;

control means connected to said video and audio display for actuating the same; and means connected to said control means for visually simulating movement of the spirits from the selected stored cinerary urn to said worshiping room while the selected urn remains in its fixed position.

4. A worshiping system as defined in claim 3 which further comprises, in combination:

carriage means located in said worshiping room;

a worshiping image mounted on the carriage means for movement between an invisible and a visible position; and means responsive to said simulated movement to said worshiping room for advancing said carriage means to move the worshiping image to its visible position.

* * * * *